US005655669A

United States Patent [19]

Moore

[11] Patent Number: 5,655,669

[45] Date of Patent: Aug. 12, 1997

[54] BOOT STORAGE FOR A SECURE CLOTHING ARTICLE FACILITY

[75] Inventor: J. Thomas Moore, Charleston, W. Va.

[73] Assignee: The Moore Company, Inc., Charleston, W. Va.

[21] Appl. No.: 703,870

[22] Filed: Aug. 27, 1996

[51] Int. Cl.[6] ..... A47F 7/00

[52] U.S. Cl. ..... 211/34

[58] Field of Search ..... 211/34, 119, 181, 211/37

[56] References Cited

U.S. PATENT DOCUMENTS

| | | | |
|---|---|---|---|
| 940,812 | 11/1909 | Hermann | 211/34 |
| 1,270,811 | 7/1918 | Darant | 211/34 |
| 2,614,268 | 10/1952 | Davies | 211/34 X |
| 2,620,074 | 12/1952 | Moore, Jr. . | |
| 2,962,253 | 11/1960 | Moore, Jr. . | |
| 3,907,115 | 9/1975 | Satchell | 211/34 |
| 4,057,211 | 11/1977 | Moore, Jr. . | |
| 4,953,715 | 9/1990 | Celli | 211/34 X |

*Primary Examiner*—Alvin C. Chin-Shue
*Assistant Examiner*—Sarah L. Purol
*Attorney, Agent, or Firm*—Cushman Darby & Cushman IP Group of Pillsbury Madison & Sutro LLP

[57] ABSTRACT

A wire storage basket is provided with a removable accessory for supporting a calf-height boot or pair of boots for storage in a position where the interior of the boot will be able to dry more rapidly in the event that it has been exposed to moisture during use by the worker; the accessory boot holder is provided with a hook for attachment to the exterior rim of the basket container and it includes a projecting arm for engaging the exterior calf portion of the boot to hold the boot in position particularly during the raising and lowering of the basket container from an access position to a storage position in a locker room.

5 Claims, 3 Drawing Sheets

BOOT STORAGE FOR A SECURE CLOTHING ARTICLE FACILITY

FIELD OF THE INVENTION

The present invention relates to an improvement in the secure storage of bootarticles in a common dressing or locker room and, more particularly, relates to an improvement in the lift basket type of personal article storage such as disclosed in U.S. Pat. Nos. 2,620,074, 2,962,253 and 4,057,211, all commonly assigned, and involves the addition of a boot carrier for carrying two boots on the outside of the basket in a secure manner and such that the upper ends of the boots will be exposed upwardly to allow evaporation to occur more rapidly during a storage period.

BACKGROUND OF THE INVENTION

Secure personal article storage containers such as disclosed in the above-noted prior U.S. patents have enjoyed widespread acceptance throughout the world where field work has necessitated that the workers change between their work clothes and their street clothes and where the clothes were required to be stored in a secure manner for the workers during a shift. In many tasks involving industry, farming, construction and the like, workers have been required to wear waterproof protection for their feet in the form of boots that have an upper rim that extends to or over the calf of the worker. Despite precautions, invariably liquid can flow into the boot during the working operations. The storage of the boot in a manner that would facilitate drying so that the worker will have ready access to his waterproof footwear during his next working shift has been desired. In many locations, it is important that the boot be secure against theft during the storage period and stored in a manner that facilitates evaporation from the interior of the boot so that the worker will be able to comfortably wear the boot during the next working shift. The prior art personal clothing article storage wire basket was generally unable to accommodate this type of footwear while satisfying the storage requirements for other clothing articles of the worker as well as drying of the interior of the boot during an off working shift.

SUMMARY OF THE INVENTION

The present invention solves this problem by providing an accessory for the clothing basket of the system disclosed in U.S. Pat. No. 4,057,211, the disclosure of which is incorporated herein by reference. In the present invention, a boot storage accessory is provided in the form of a boot carrier having a portion for engaging the rim of the storage basket and having a first portion for receiving the toe and a portion of the sole of the boot in a manner such that the calf portion of the boot will remain elevated above the sole portion without taking up valuable space in the storage basket which is normally used for other articles of clothing of the worker. The boot carrier can then be lifted to a storage position by the chain disclosed in U.S. Pat. No. 4,057,211 without interference and without compromise of the security of the locked storage position. Moreover, when the conditions do not require the workers to wear waterproof boots, the boot carrier of the present invention can be easily detached for separate storage.

The foregoing and other advantages will become apparent as consideration is given to the following detailed description taken in conjunction with the accompanying drawings, in which:

DETAILED DESCRIPTION OF THE INVENTION

Figure 1:
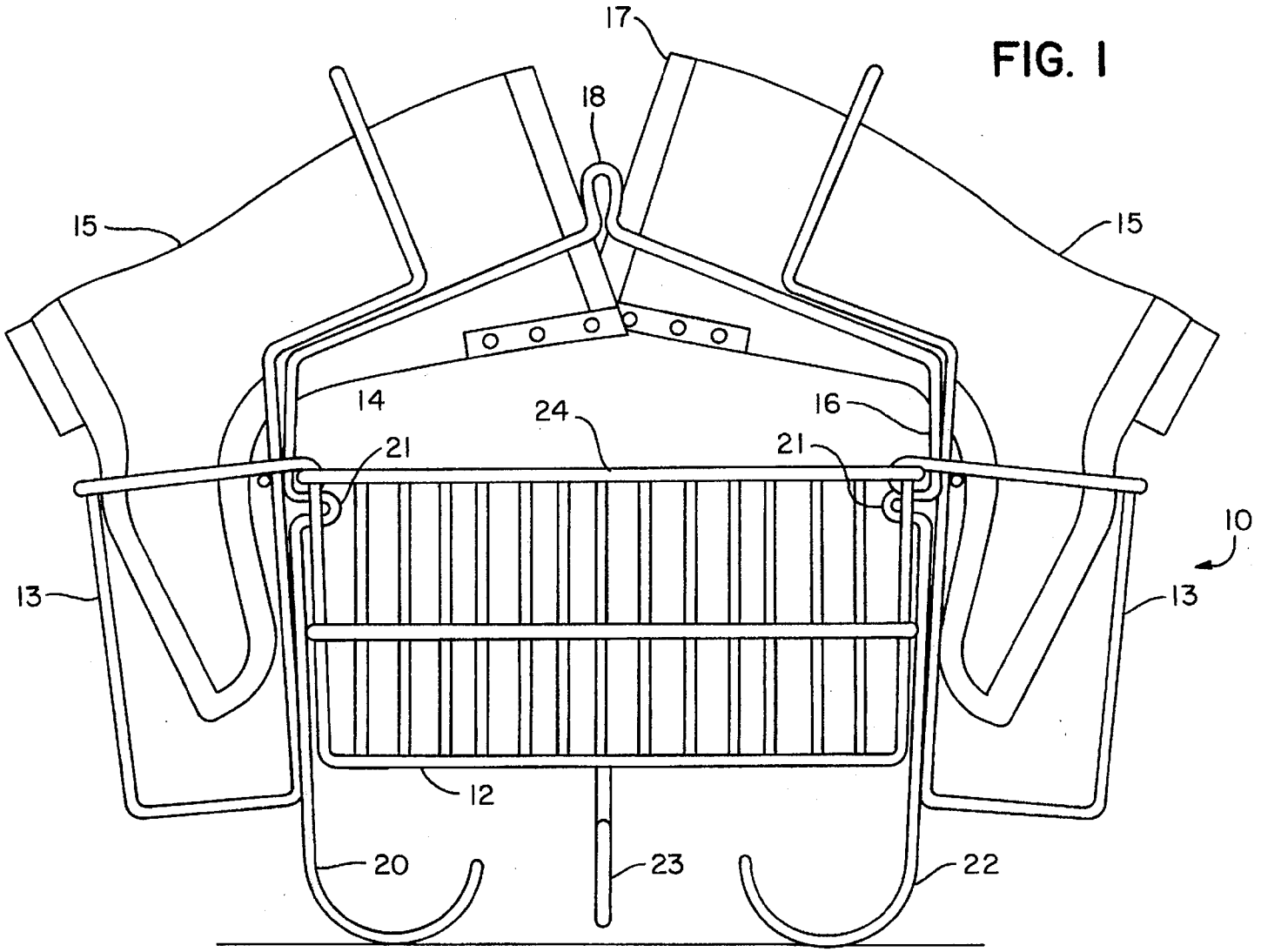
FIG. 1 is a side view in elevation of the boot carrier of the present invention installed on a personal article container of the prior art.

With reference to the drawings wherein like numerals designate corresponding parts, there is shown in FIG. 1 at 10 a personal article receptacle 12 on which two boot carriers 13 are positioned for use to carry boots indicated at 15 in a position that facilitates evaporation through the open upper ends such as at 17. The receptacle 12 may be made in the manner and with the structure described in U.S. Pat. No. 4,057,211. As there described, the receptacle 12 is formed with an open top surrounded by an upper edge 24, a bale handle 14 in a centrally located bend at 18 to which is attached the hook end of a lifting line which may be a link chain as described in the aforementioned U.S. patent. Intermediate the ends of the arms 14 and 16, inwardly projecting bends in the wire of arms 14 and 16 are provided as at 21 to engage beneath the upper rim wire 24 to support the basket receptacle 12 between the depending arms 14 and 16. The lower ends of the arms 14 and 16 extend beneath the bottom wall of the receptacle 12 and they terminate in hooks 20 and 22 to provide locations for hanging clothing articles. A centrally located wire frame 23 having an opening for receiving hanger hooks may also be supplied. The member 23 may be attached to the bottom wall of the receptacle 12 or to a reinforcing plate 26, shown in FIG. 2, which is attached by hooked bolts 28 or any other suitable attachment means to the side wire frame members of the receptacle 12 or to the arms 14 and 16.

Typically, a worker will place personal articles in the receptacle 12 and hang street clothing from the hooks 22 or on hangers which are suspended from the member 23.

Figure 3:
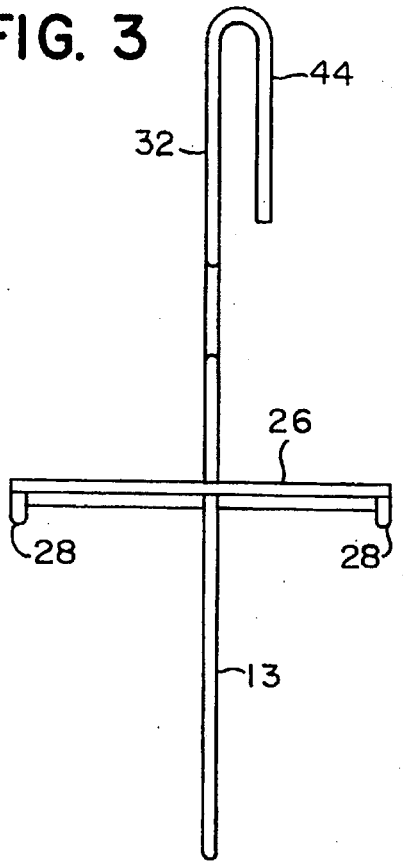
FIGS. 3 and 4 are, respectively, front and side elevational views of the boot carrier of the present invention.
Figure 4:
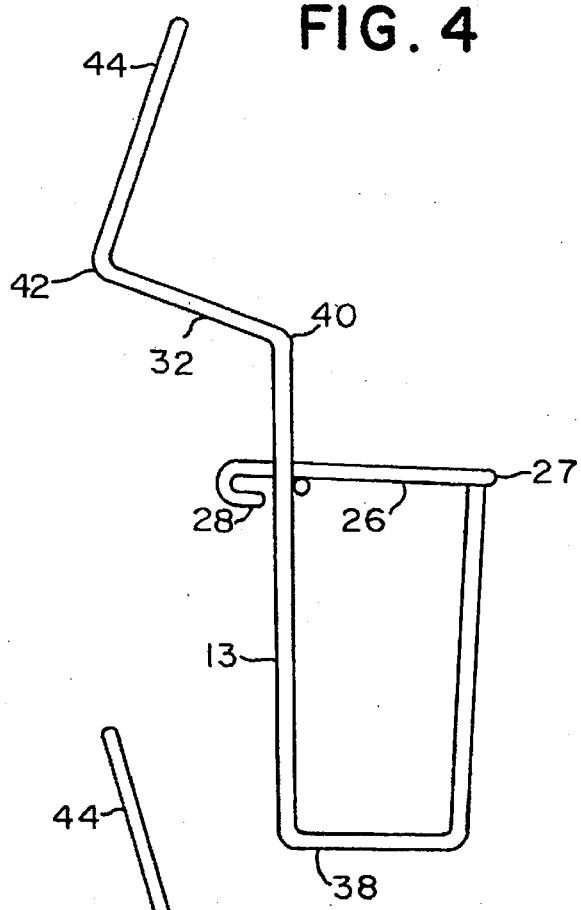
Figure 5:
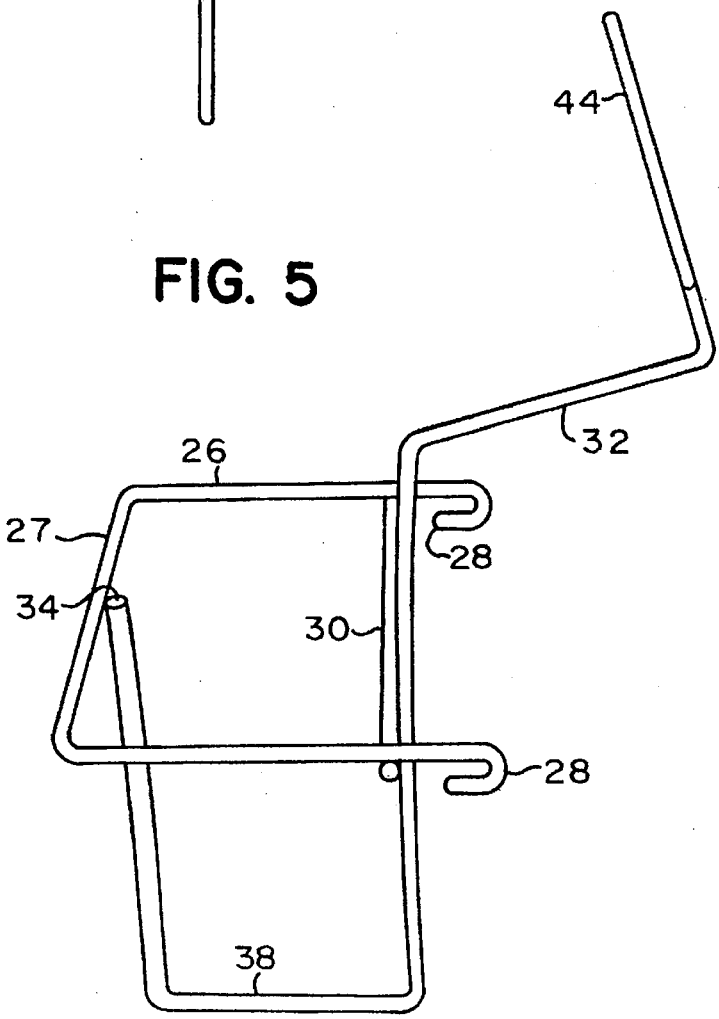
FIG. 5 is a perspective view from above of the boot carrier of the present invention.

To enable the article receptacle 12 to carry two large boots 15 in an efficient manner without requiring any modification of the already installed receptacle 12, the present invention provides a relatively inexpensive and durable accessory in the form of a boot carrier 13 which is made from heavy gauge wire which can be easily formed by bending into the desired shape. As shown in FIGS. 3, 4 and 5, each boot carrier 13 has a toe receiving pocket 26 which is preferably formed from a single segment of wire bent into a U-shape with the free ends of the legs of the U terminating in hooks 28 which extend beyond the wire portion 30 by a distance sufficient to enable the hooks to engage the rim wire 24 of the receptacle 12 while accommodating the location of the bale arms 14 and 16 as well as the calf retaining arm 32 of the boot carrier 13. The toe and calf retaining portions are formed from a single wire 32 which at one end is welded as at 34 which is located approximately at the midpoint of the leg segment 27 of the member 26. From the weld 34, the member 32 extends at a slight angle downwardly to a base leg 38 and then upwardly in a rectilinear manner to another bend at 40. The interval between the bend 40 and 42 may be selected to accommodate the height of the boot to be carried in the boot carrier 13. At the bend 40, a retaining hook is provided at 44. Stiffness is imparted to the structure by welding the cross segment 30 to the underside of each of the legs of the U-shaped member 26 and to the adjacent portion of the wire member 32.

Figure 2:
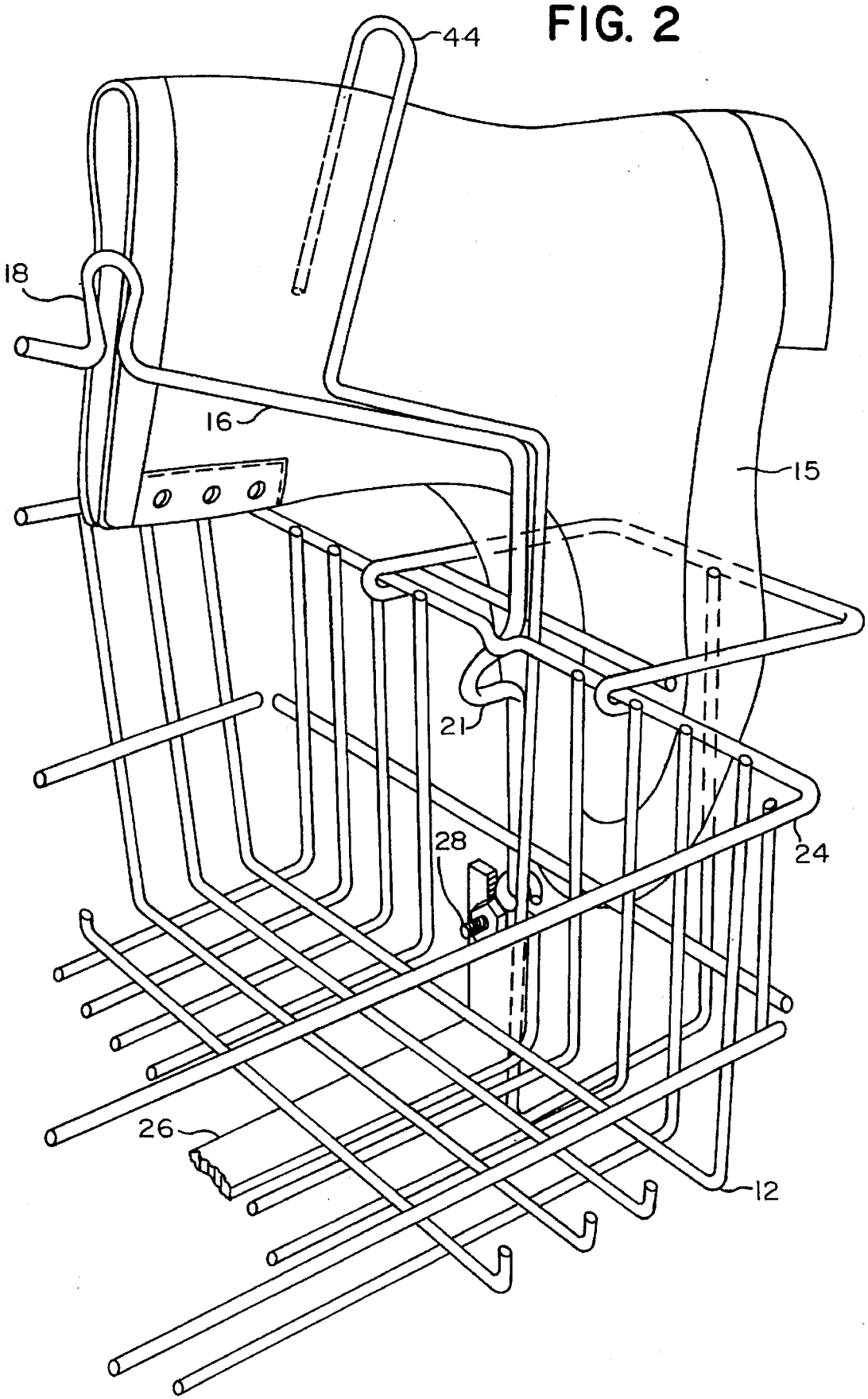
FIG. 2 is an enlarged perspective view of one of the boot carriers of FIG. 1.

In use, the boot carrier 13 will be attached to the upper rim 24 of a receptacle 12 so that the generally vertically extending portion of the wire 38 will engage the side wall of the receptacle 12 to achieve a stable positioning of each boot carrier 13 on the receptacle 12. The user will then insert the toe of a boot through the member 26 and by modest flexing insert the upper portion of the boot into the hook 44. Preferably, the hook 44 will provide a guard against tilting of the boot which is important in these types of storage facilities where the receptacle 12 is raised and lowered, sometimes in a rough manner by the user. In addition, the clearance in the hook 44 will be of sufficient dimension to allow free air flow out of the upper edge of the boot as shown in FIG. 2.

The boot carrier of the present invention can be utilized with the prior art storage facilities for these types of receptacles without interfering with the securing features of these types of installations and without interfering with the raising and lowering of the receptacles for use by a worker. In addition, the boot carrier 13 can be easily removed when there is no need for their installation at a site.

Having described the invention, it will be apparent that various modifications may be made therein without departing from the spirit and scope of this invention as defined in the appended claims.

What is claimed is:

1. A storage container for articles, comprising a container body having an upper end and a base and a side extending between said upper end and said base, a suspension arm extending across said upper end for engagement with a suspension line, a boot carrier comprising a first portion for receiving the foot portion of a boot, said first portion including an attachment member for engaging said upper end of said container to position said first portion outside said container to extend along said side of said container, said boot carrier including a second portion extending from said first portion and comprising a boot carrier arm having a retainer portion for frictionally engaging the upper leg portion of a boot, said boot carrier arm extending over at least a portion of said upper end of said container.

2. The invention as claimed in claim 1 wherein said container is a wire frame basket.

3. The invention as claimed in claim 2 wherein said boot carrier is a wire member having an open upper end and bottom.

4. The invention as claimed in claim 3 wherein said attachment member is a hook which engages said upper end of said container.

5. The invention as claimed in claim 3 wherein said retainer portion is wire bent in a generally U-shape having an opening facing toward said container.

* * * * *